United States Patent [19]

Brauer et al.

[11] Patent Number: 4,660,523

[45] Date of Patent: Apr. 28, 1987

[54] PIEZOELECTRIC CONTROL BLOCK

[75] Inventors: Ilan Brauer; Gerhard Brüggen, both of Stuttgart; Dieter Karr, Leonberg, all of Fed. Rep. of Germany

[73] Assignee: Robert Bosch GmbH, Stuttgart, Fed. Rep. of Germany

[21] Appl. No.: 783,753

[22] Filed: Oct. 3, 1985

[30] Foreign Application Priority Data

Nov. 9, 1984 [DE] Fed. Rep. of Germany ..... 3440942

[51] Int. Cl.[4] ..... F02M 39/00

[52] U.S. Cl. ..... 123/458; 123/498; 123/462

[58] Field of Search ..... 123/458, 498, 462, 459, 123/502

[56] References Cited

U.S. PATENT DOCUMENTS

| | | | |
|---|---|---|---|
| 3,520,641 | 7/1970 | Casey | 123/498 |
| 3,753,426 | 8/1973 | Lilley | 123/498 |
| 4,463,727 | 8/1984 | Babitzka | 123/458 |
| 4,538,580 | 9/1985 | Staubel | 123/458 |
| 4,550,744 | 11/1985 | Igashira | 123/447 |
| 4,588,908 | 6/1986 | Babitzka | 123/446 |

FOREIGN PATENT DOCUMENTS

| | | | |
|---|---|---|---|
| 2086080 | 5/1982 | United Kingdom | 123/458 |

*Primary Examiner*—Carl Stuart Miller
*Attorney, Agent, or Firm*—Michael J. Striker

[57] ABSTRACT

A piezoelectric control block, particularly for controlling a fuel injection device for a combustion engine, preferably diesel engine, with a distributor injecting pipe, has an adjustable fuel quantity adjusting member, and a longitudinally extending mechanical movement converter which is formed so that under longitudinal load it deforms transversely to its longitudinal expansion and has a part which performs an overproportional movement under the longitudinal load and is connected with the feed quantity adjusting member.

10 Claims, 2 Drawing Figures

PIEZOELECTRIC CONTROL BLOCK

BACKGROUND OF THE INVENTION

The present invention relates to a piezoelectric control block.

More particularly, it relates to a piezoelectric control block for controlling a fuel injection device for a combustion engine, preferably diesel engine, with a distributor injection pump and a feed quantity adjusting member which is adjustable in dependence on different parameters converted in control signals by an electronic control device.

Control blocks of the above-mentioned general type operate piezohydraulically or with piezoelectrically controllable bending points. They operate quite satisfactorily. However, they require a relatively high manufacturing cost. Moreover, especially the bending points are somewhat susceptible to vibration.

SUMMARY OF THE INVENTION

Accordingly, it is an object of the present invention to provide a piezoelectric control block which avoids the disadvantages of the prior art.

More particularly, it is an object of the present invention to provide a piezoelectric control block of the above-mentioned general type which has a stable and compact construction.

In keeping with these objects and with others which will become apparent hereinafter, one feature of the present invention resides, briefly stated, in a piezoelectric control block of the above-mentioned type in which a longitudinally extending mechanical movement converter is provided and preformed so that under a longitudinal load it buckles in or out or bulges in or out, and during buckling or bulging by the longitudinal load a part of the converter performs an overproportional movement and is connected with the feed quantity adjustment member.

Because of direct taking over of the adjusting movement through the feed quantity adjustment member, a play-free transmission is possible without otherwise conventional transmission error and it is guaranteed that the control block operates with high precision and always in the same working region.

In accordance with a specially advantageous feature of the present invention, which provides a stable construction, the mechanical movement converter is designed in accordance with a toggle lever principle. For example, it is formed with two similar symmetrically oppositely curved or somewhat bent spring bands whose ends are connected with one another and with a piezoelectric driver located between these ends and between the spring bands.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
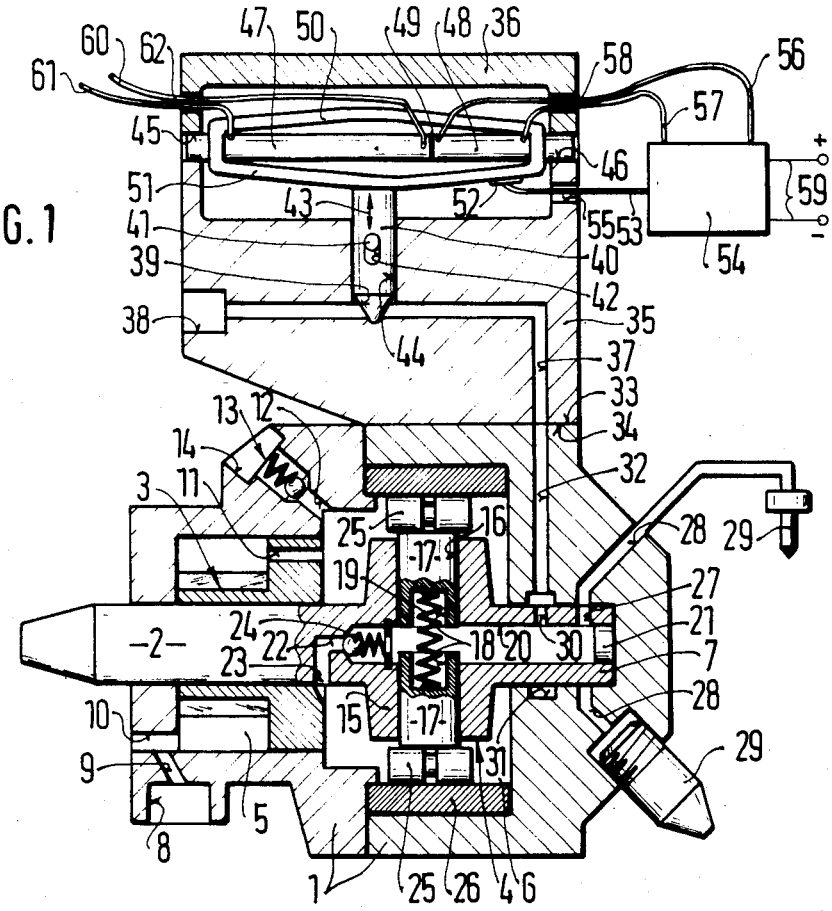
FIG. 1 is a view showing a longitudinal section of an injection device with a control block in accordance with the present invention.

As can be seen from FIG. 1, housing 1 is composed of two parts and supports a shaft 2. The housing 1 has chambers 5 and 6 which accommodate respectively a vane pump 3 connected with the shaft 2 and a double piston pump 4 which is also connected to the shaft 2. A distributor 7 is formed on one end of the shaft 2 supported in a distributor cylinder.

The housing has a port 8 for a fuel supply. Passages 9 and 10 lead from the port 8 to the chamber 5 of the vane pump 3. A passage 11 communicates the pressure side of the chamber 5 with the chamber 6. A passage 12 leads from the chamber 6 via a pressure limiting valve 13 to a port 14 for a fuel return.

The core 15 of the shaft 2 is arranged in the chamber 6. A cylindrical opening 16 extends in the direction of diameter of the collar. A piston pair 17 is displaceably supported in the cylindrical opening 16. The pistons of the piston pair 17 are provided with openings 18 in their bottoms which face toward one another. A helical spring 19 is arranged with prestress in the openings 18.

The shaft 2 has a longitudinal opening 20 which is closed at its end by a plug 21. The opening 20 extends transversely to the opening 16 toward a driven end of the shaft until it merges via a cone into an axial opening 22. The axial opening 22 is connected by means of a radial opening 23 with the chamber 6. A ball of a jack valve 24 is located in a transition cone between the longitudinal opening 20 and the axial opening 2. Each piston of the piston pair 17 abuts outwardly against a roller pair 25. The roller pair 25 is thereby pressed against an inner cam track of a cam 26. Shortly before the plug 21 a radial opening 27 branches in the shaft 2 from the longitudinal opening 20. The radial opening 27 can coincide with one of several passages 28 which are arranged in a star-like manner around the shaft, depending on the rotary position of the shaft 2.

The passages 28 lead to injection valves 29. A further radial opening 30 in the shaft 2 communicates the longitudinal opening 20 with an annular groove 31 of the housing 1. A passage 32 leads from the annular groove 31 to an end surface 33 of the housing 1. A housing 35–36 of a piezoelectric control block abuts with its end surface 34 against the end surface 33 of the housing 1.

The above-mentioned passage 32 opens into a passage 37 of the housing 35. The passage 37 leads to a port 38 for a further return conduit. In the region of the passage 37, a conical valve seat 39 is provided. A movable adjusting member 40 has a conical tip and cooperates with the conical valve seat 39. A pin-slot connection 41/42 limits the movement of the adjusting member 40 in direction of the arrow 43 in two end positions. The adjusting member 40 is guided in an opening 44 of the housing 35.

Bearing openings 45 and 46 are formed in the separating region between the housing parts 35 and 36 partially in the housing 35 and in the housing 36. The ends of a respective piezoelectric element are supported in the bearing openings 45 and 46. One of the piezoelectric elements is a piezoelectric driver identified with reference numeral 47, whereas the other piezoelectric element is a piezoelectric compensator identified with reference numeral 48. Both elements 47 and 48 are in alignment with one another and insulated from one another in the region of their contact by a plate 49. The plate 49 is glued between the end surfaces of both elements 47 and 48 so that they are mechanically connected with one another.

The elements 47 and 48 have outer ends, and the ends of mutually symmetrical spring bands 50 and 51 are connected with the outer ends of the elements 47 and 48. The spring bands 50 and 51 receive the elements 47 and 48 therebetween. Both spring bands 50 and 51 are pre-formed so that their average distance measured normal to the longitudinal axes of the elements 47 and 48 is greater than the distance between their ends measured in the same direction. A longitudinal change of both interconnected structural elements 47 and 48 thereby result in bending in or bending out of the spring bands 50 and 51. Because of this construction in accordance with the toggle lever principle, the operational properties of the piezoelectric elements 47 and 48 are advantageously evaluated. The high adjusting force with the small adjusting path is converted into a smaller adjusting force with greater adjusting path on the adjusting member 40.

Further, the spring band 51 is connected via a pin on the adjusting member 40 firmly with the adjusting member 40. Moreover, the spring band carries a temperature sensor 52 which is connected via a conduit 53 with an electronic control unit 54. The conduit 53 extends through an opening in the housing 35. Conduits 56 and 57 lead through an opening 58 in the housing 36 to electrical terminals at both ends of the piezoelectric compensator 48.

Figure 2:
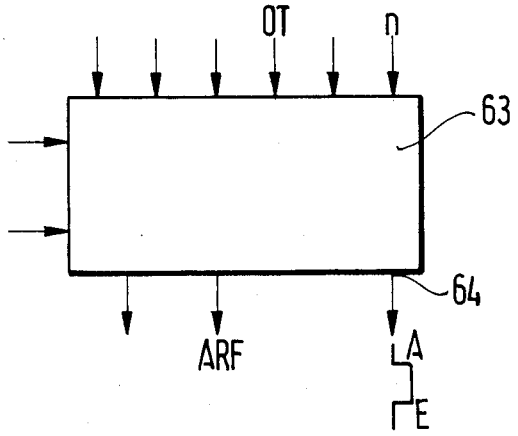
FIG. 2 is a view schematically showing the electronic control device with inputs for various parameters and outputs for control impulses, for controlling the piezodriver.

Reference numeral 59 identifies supply conduits for the electric control unit 54. Conduits 60 and 61 are connected with the electrical contacts at the ends of the piezoelectric driver 47. They extend through an opening 62 in the housing 36 and end on a known control device 63 which is schematically shown in FIG. 2 with its cutting points. Parameters to be considered are inputs for signals for the number of revolutions of the engine, the load, the position of the upper dead point for the cylinder 1, the temperature of oil, water and air, the fuel type and the air pressure or intake pressure.

A first output 64 serves for delivering the signal for switching on and switching off of the control voltage for the piezoelectric driver 47. Further outputs of the control device 63 can control, for example, the exhaust gas return or the emergency turning off of the engine.

When the fuel injection device is set in operation, the shaft 2 is rotated. The vane pump 3 driven thereby aspirates fuel from the port 8 and pumps it at the pressure side from the chamber 5 through the passage 11 to the passage 6. From the thus filled chamber 6 the fuel is aspirated by the double piston pump 4 via the ball valve 24 and pumped by the piston pair 17 into longitudinal opening 20 of the distributor 7. From there it is pumped through the radial opening 27 in one of the channels 28 to the injection nozzle and via the radial opening 30 and through the channels 32 and 37 to the adjusting member 40. If the channel 37 is opened by the adjusting member 40, the fuel flows via the return conduit connected at 38 back into the fuel supply container without forming before the injection valve a fuel pressure required for its opening. A fuel injection does not take place in the event of the open passage 37.

After the piezoelectric driver 47 performs relatively small longitudinal changes during application of different voltages, the longitudinal changes which take place by the temperature variations are not negligibly small in relation to the total adjustment path. The switching movements of the adjusting member 40 can lead because of such longitudinal changes too early or too late to opening or closing of the passage 37. The piezoelectrical compensator 48 serves for compensation of such an error. Depending on the temperature detected by the temperture sensor 52, the piezoelectric compensator 48 receives from the electrical control unit 54 a voltage which acts so that the error influences which take place because of the temperature variations can be compensated by respective longitudinal changes of the piezoelectric compensator 48.

It will be understood that each of the elements described above, or two or more together, may also find a useful application in other types of constructions differing from the types described above.

While the invention has been illustrated and described as embodied in a piezoelectric control block, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A piezoelectric control block, particularly for controlling a fuel injecting device for a combustion engine, advantageously diesel engine, with a distributor injecting pump, the piezoelectric control block comprising a feed quantity adjusting member; and a longitudinally extending mechanical movement converter which is formed so that under a longitudinal load it deforms transversely to its longitudinal expansion, said movement converter having a part which performs an overproportional movement in response to the transverse deformation of said movement converter under the action of the longitudinal load, said part being connected with said feed quantity displacing member, said movement converter being formed as a piezoelectric driver apparatus which includes said part and a second part arranged at an angle relative to one another and articulately connected with one another, said parts having fixed ends and being articulately connected at said fixed ends.

2. A piezoelectric control block, particularly for controlling a fuel injecting device for a combustion engine, advantageously diesel engine, with a distributor injecting pump, the piezoelectric control block comprising a feed quantity adjusting member; and a longitudinally extending mechanical movement converter which is formed so that under a longitudinal load deforms transversely to its longitudinal expansion, said movement converter havig a piezoelectric driver means and a part which is transversely deformable and performs an overproportional movement in response to the transverse deformation of said movement converter under the action of the longitudinal load, said part being connected with said feed quantity displacing member and formed as a curved spring band with ends which are spaced from one another by a distance changeable by said piezoelectric driver means so as to provide said overproportional movement of said spring band, said spring band having a portion which is transversely deformable and connected with said feed quantity adjusting member.

3. A piezoelectric control block as defined in claim 2, wherein said spring band of said mechanical movement converter is bent.

4. A piezoelectric control block as defined in claim 2, wherein said spring band includes two equal mutually symmetrical opposite spring parts which are curved and have ends connected with one another, while said spring band parts being arranged to carry said feed quantity adjusting member.

5. A piezoelectric control block as defined in claim 2, wherein said spring band parts are bent.

6. A piezoelectric control block as defined in claim 2, wherein said piezoelectric driver means is located between said ends of said spring band and is connected with said spring band.

7. A piezoelectric control block as defined in claim 2, wherein said piezoelectric drive means is composed of two piezoelectrically longitudinally changeable structural elements, one of said elements being arranged to move said feed quantity adjusting member, the other of said elements being formed as an expansion compensator; and further comprising a control device which controls said one element for moving said feed quantity adjusting member.

8. A piezoelectric control block as defined in claim 7; and further comprising a temperature sensor, said other element is formed as an expansion compensator being connected with said temperature sensor.

9. A piezoelectric control block as defined in claim 8; and further comprising an electronic control unit which converts signals of said temperature sensor in control signals for an electric voltage applied to said expansion compensator, said control unit being connected with said other element formed as an expansion compensator.

10. A piezoelectric control block as defined in claim 2; and further comprising two abutments, said feed quantity adjusting member being formed so that it reciprocates between said two abutments.

* * * * *